US008850986B1

(12) United States Patent
Alalati

(10) Patent No.: US 8,850,986 B1
(45) Date of Patent: Oct. 7, 2014

(54) CYLINDRICAL (DRUM) CENTERFIRE CARTRIDGE'S PRIMER

(71) Applicant: Anwar A. M. Alalati, Al waha (KW)

(72) Inventor: Anwar A. M. Alalati, Al waha (KW)

( * ) Notice: Subject to any disclaimer, the term of this patent is extended or adjusted under 35 U.S.C. 154(b) by 0 days.

(21) Appl. No.: 13/941,128

(22) Filed: Jul. 12, 2013

(51) Int. Cl.
*F42B 5/02* (2006.01)

(52) U.S. Cl.
CPC ..... *F42B 5/02* (2013.01)
USPC ..... 102/470

(58) Field of Classification Search
CPC ..... F42C 19/085; F42C 19/0819
USPC ..... 102/470–472, 469, 202.5, 204, 202.12, 102/205, 202, 202.6, 202.9
See application file for complete search history.

(56) References Cited

U.S. PATENT DOCUMENTS

| | | | | |
|---|---|---|---|---|
| 238,039 | A * | 2/1881 | Gardner | 102/470 |
| 2,708,878 | A * | 5/1955 | Eckstein | 102/470 |
| 5,773,748 | A * | 6/1998 | Makowiecki et al. | 102/205 |

* cited by examiner

*Primary Examiner* — Reginald Tillman, Jr.
(74) *Attorney, Agent, or Firm* — Merek, Blackmon & Voorhees, LLC

(57) ABSTRACT

The present invention relates to a novel cylindrical drum design to eliminate the need for the adhering method in the primer's design, while providing protection against the effects of temperature variance, age, and physical movement of the cartridge. The present invention provides continuous operable positioning of the priming mixture between the firing pin and the disc area (anvil) without requiring the addition of glue to the priming mixture. A cylindrical disk provides a shelf for containing an amount of starter priming mixture that replaces the conical anvil. A throat provides a restriction to maintain the mixture on the shelf, and provides for the flame to travel to a main conical or other shaped chamber to provide an efficient flame to the main propellant chamber for efficient and complete burning of the propellant. Seals may be provided at either or both ends of the primer.

18 Claims, 3 Drawing Sheets

CYLINDRICAL (DRUM) CENTERFIRE CARTRIDGE'S PRIMER

BACKGROUND OF THE INVENTION

1. Field of the Invention

The present application relates to a sealed primer design for a center-fire cartridge having a novel priming compound housing structure to provide a primer having a longer life and higher reliability than current designs.

2. Description of the Prior Art

Currently manufactured primers for cartridge ammunition ("cartridge") can fail to fire in as much as 5% of the time due to moisture breaking down the glue holding the ignition primer mixture in place for proper contact by a firing pin. In general, most centerfire primers available or currently manufactured for use in centerfire cartridge's use a method called "adhering." This method is the process of adding a gluing chemical substance to the priming mixture to make it stick ("adhere") to the inside of the outer brass cup of the primer and to remain in position so it can be compressed between the firing pin and the anvil to provide the spark of ignition.

As mentioned above, this method is only about 95% efficient in newly made cartridges. In the remaining 5%, there will be a number of cartridges that fail to operate because of this lack of adherence, a factor known to cartridges of all manufacture. This risk can result in an unacceptable failure of the firearm to fire in a critical situation. Even if the risk can be reduced to one cartridge that will fail in 1000, there is still a risk for the shooter in situations where his life may depend on avoiding that "unlucky" cartridge.

Additionally, in the long run with years of stocking and handling these cartridges and with temperature variations, this can lead to an increase in the likelihood of primer failure. The physical movement alone can lead to cracking or failure of the adherence resulting in the priming mixture falling away from the proper position where the firing pin meets the anvil causing the cartridge to fail to ignite. The temperature variation in long periods can also defeat the adhering method. Nevertheless, any method relying on adding a certain chemical gluing substance to priming mixture can be corrupted the priming mixture in the long run causing some older cartridges to fail to ignite.

SUMMARY OF THE INVENTION

The present invention relates to a novel cylindrical drum design to eliminate the need for the adhering method of cartridge design, while providing protection against the effects of temperature variance, age, and physical movement of the cartridge. The present invention provides continuous operable positioning of the priming mixture between the firing pin and the disc area (anvil) without requiring the addition of glue to the priming mixture.

Without requiring the use of adhering, the cylindrical drum is designed to hold charges of priming mixture firmly in place. A starter priming charge rests on the starter disc (anvil) firmly and securely in place by a bottom seal. Firstly, a main priming charge is preserved inside the coned or shaped room and is locked by an upper seal. These are kept and preserved in the space that is designed for them in their original state without adding any forms of substance (i.e., glues). The priming mixtures are filled manually or is automatically inside the cylindrical drum and then are sealed and are ready to use.

Secondly, the seals will prevent any movements to the priming mixture. The sealers act as a lock mechanism so the priming mixture will never fall off or spill away from the proper position required for positive ignition. The primer design can thus guarantee a 100% ignition rate for a period of years in a more reliable manner than other types of primers Thirdly, the use of aluminum or copper seal foils will help in protecting against static electricity, and will also prevent any transfer of humidity to the inside of the cylindrical body.

Accordingly, it is a principal object of a preferred embodiment of the invention to provide a cartridge having a novel primer.

It is another object of the invention to provide a primer that is sealed at both ends to extend the longevity of the cartridge.

It is a further object of the invention to provide a primer that has an upper dish for containing primer, a throat section and a conical, cupped or other shaped main priming compound housing for providing a reliably firing primer without requiring gluing or other adhering methods of maintaining the priming mixture in position.

It is an object of the invention to provide improved elements and arrangements thereof in an apparatus for the purposes described which is inexpensive, dependable and fully effective in accomplishing its intended purposes.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention relates to a novel design for a primer for cartridge ammunition and the like.

Figure 1:
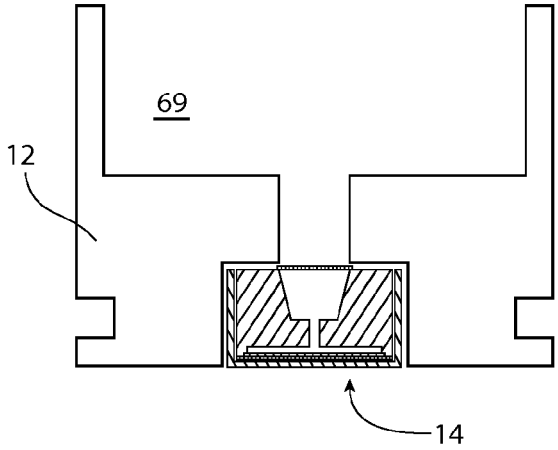
FIG. 1 is partial cross-sectional view of a cartridge and primer according to at least one embodiment of the invention.
Figure 4:
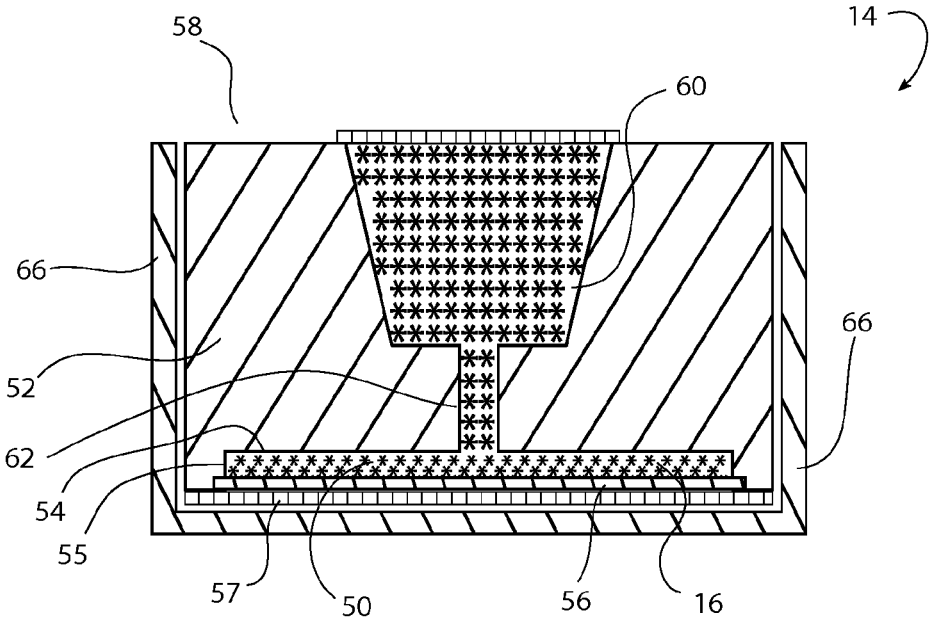
FIG. 4 is a diagrammatic cross-sectional view of a primer according to at least one embodiment of the invention.
Figure 5A:
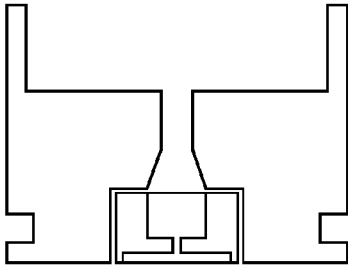
FIGS. 5A-E are diagrammatic cross-sectional views of main priming chamber and flash hole configurations.
Figure 5B:
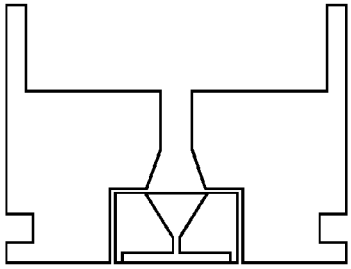
Figure 5C:
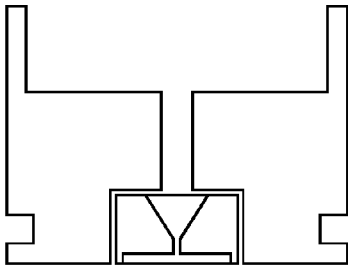
Figure 5D:
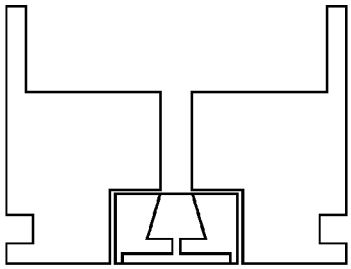
Figure 5E:
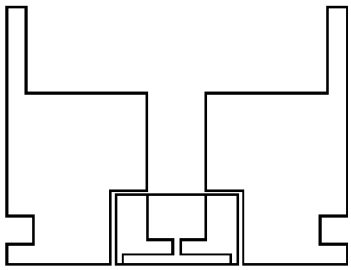

FIGS. 1 & 4 shows a partial cross-sectional view of a cylindrical primer according to at least one embodiment of the invention. Cartridge ammunition 12 is provided with a primer 14 that is fired by a firing pin (not shown) to cause the pressure-reactive priming mixture 16 to ignite to then subsequently cause the gun powder, smokeless powder, cordite or other propellant to subsequently launch a bullet (not shown) or other projectile in the desired direction.

Figure 2:
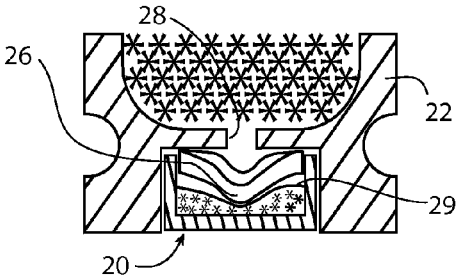
FIG. 2 PRIOR ART
FIG. 2 is a partial cross-sectional view of a prior art Boxer cartridge and primer.
Figure 3:
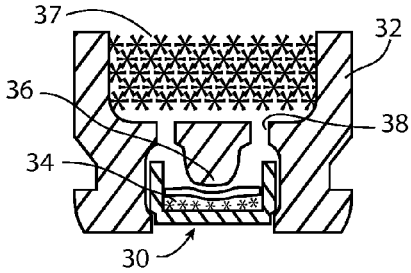
FIG. 3 PRIOR ART
FIG. 3 is a partial cross-sectional view of a prior art Berden cartridge and primer.

FIGS. 2 & 3 show prior art primers. FIG. 2 shows a prior art boxer primer 20 installed on a cartridge 22. The primer 20 has an outer cup with a priming mixture 24 contained therein. A firing pin (not shown) strikes the cup causing it to suddenly compress the priming mixture between the cup and an anvil 26. The sudden is compression causes the priming mixture to ignite. A flash hole 28 in the primer allows the ignited priming mixture to ignite the gun powder (not shown) of the cartridge 22. Foil layers 29 may be provided to separate components of the cartridge and primer. The ignition of the propellant causes a sudden rise in pressure in the cartridge expelling ("launching") the projectile at the end of the cartridge down the barrel of the firearm towards the target.

FIG. 3 shows another common form of a cartridge and primer. The Berden primer has a plurality of flash holes 38 on the primer 30 to allow the more efficient ignition of the propellant 37. The anvil 36 of the Berden primer is integral with the cartridge case 32 instead of being a part of the primer, but otherwise serves the same function of providing a hard surface for the priming mixture 34 to be compressed against by the firing pin (not shown).

By contrast the cylindrical primer of the current invention as best seen in the diagrammatic view of FIG. 4, shows that the primer 14 that does not rely on a conical anvil. The primer has a starter disc or compartment 50 that is preferably cylindrical and has a smaller diameter than the cylindrical primer body 52. The started disk is bounded by cylindrical wall 55 and circular shelf 54. The primer disk is preferably formed in the cylindrical primer body 52 by drilling, casting or by other means. The cylindrical body 52 is preferably made of brass, copper, aluminum, or stainless steel, but may be made of other materials as needed.

The primer disc 52 contains an amount of ignition priming mixture 16 that starts ignition in the primer. The ignition priming mixture ignites on sudden compression like its predecessors, but does not require an adhering method such as glue mixed into the priming mixture. The shallow started disk allows a firing pin (not shown) to compress the priming mixture against the circular starter disk shelf 54 of the starter disc to reliably compress a sufficient amount of priming mixture to cause ignition. The starter disk outer walls 55 preferably have a depth of about 0.005-0.020 inches depending on the size of the cartridge or as needed for the intended purpose. The starter disk 50 may have a diameter of 0.059 to 0.215 inches, but may vary according to the size of the cartridge and for other purposes. Preferably the seals and starter disk are provided in small, medium and larger sizes for standardization, but may be provided in any size without departing from the scope of the invention, especially where the primer is used as a fuse for non-firearm purposes. Because a central anvil is not required, the constant depth provided by the starter disk shelf offers a more uniform amount of priming mixture that will be compressed between the firing pin and the shelf. And because the shelf 54 ("anvil surface") has limited areas for the priming mixture to flow out of the shelf, there is no requirement for adhering methods such as glue to be mixed with the priming mixture to ensure that priming mixture is ignited when the firing pin strikes the primer. These features will ensure a more reliable primer operation over long periods even after handling and transportation.

A thin bottom sealing layer 56 may also be provided over the cylindrical body 52 to seal the priming mixture in the starter disc. The seal 56 is preferably 0.001-0.004 inches in thickness, but may be thicker for military or other purposes. This sealing layer provides both the property of ensuring the priming mixture will stay located in the starter is disc 50 and also prevents moisture and other impurities from reaching the priming mixture and degrading the priming mixture. The started disc provides for a larger strike area for the firing pin to further increase the reliability of the priming igniting on the first strike by the firing pin. The starter disc clearance depth walls 55 also provides an easily controllable distance ("depth") between the bottom of the primer (where the firing pin strikes) and the surface 54 of the starter disc 50 with more restriction on the movement of the priming mixture 16 than in the previous primers.

The main priming mixture is contained in the main priming room 60. The priming room 60 may have various shapes, including those described hereunder, but preferably is conical in shape so that the flame provided by ignition of the main priming mixture is sufficient to positively and fully burn the smokeless powder or other propellant inside the cartridge 12. A paper or metal foil 58 such as brass, aluminum or copper may be provided and attached to the top of the primer to seal the main priming room 60 for similar reasons to seal 56. The seal 58 is preferably 0.002-0.004 inches in thickness, but may be thicker for military or other purposes.

A throat section 62 may be provided between the starter disk shelf 50 and the main mixture room 60. The throat section provides several benefits. Firstly it provides a restriction to the travel of the starter priming mixture 16 ensuring that there is sufficient priming mixture 16 in place on the starter disk shelf 50 to ensure that the primer ignites when struck by the firing pin. That is, there are no voids on the starter disk. Secondly, the throat provides a travel path from the ignition of the starter priming mixture 16 to the main priming mixture 60. This also allows for the main priming mixture to reliably have the flame initiate at the center of the chamber and then flow in the desired shaped pattern provided by the main chamber 60 to efficiently ignite the cordite or other propellant. A plurality of throats ("throttle sections") could be provided to replace a Berden type primer.

Figure 6A:
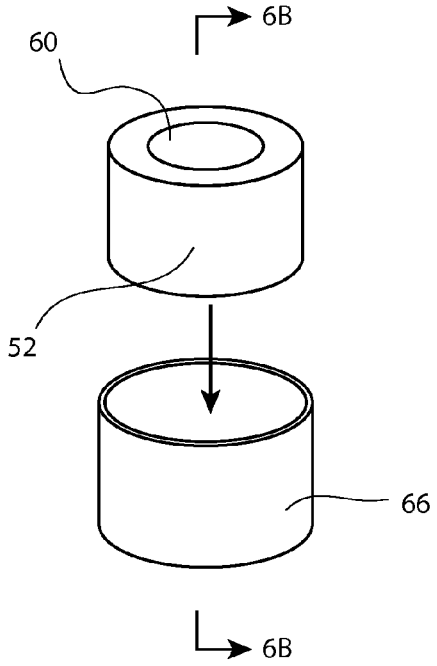
FIG. 6A is a diagrammatic view of a cylindrical primer body being installed in a cup according to one embodiment of the present invention.
Figure 6B:
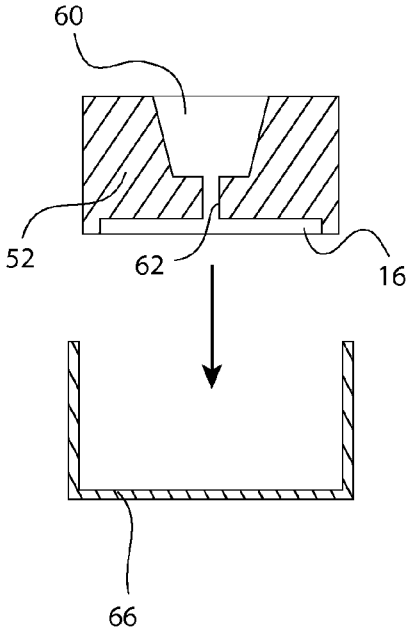
FIG. 6B is a diagrammatic, cross-sectional view of a cylindrical primer body being installed in a cup according to one embodiment of the present invention.

As shown in FIGS. 1 & 4, the primer 14 preferably has a cup 66 made of brass or other metal over the seal 56 which is attached to the bottom surface of the cylindrical primer body as a unitary unit. The cup in installed over and surrounds the primer (See FIGS. 6A&B, seals omitted for clarity) for protection of the primer as it is installed in the cartridge case 12. An optional spacer or shock absorber 57 could be provided between the primer bottom and the cup 66 to protect the primer during handling and harsh physical vibrations and the like. The size and dimensions of the cup may be governed by SAAMI or made according to manufacturer's specifications. FIG. 1 shows a cartridge 22 having a primer 14 installed according to the present invention. The primer includes an outer brass cup 66, a lower protection seal 56 and an upper protection seal 58. The optional shock absorber 57 is in the bottom of the primer body. The upper seal 58 separates the flash hole 28 of the cartridge from the primer main priming mixture. Together the upper and lower seal completely hermetically seal the primer from the environment. The flash hole carries the flame from the main priming mixture to the propellant powder chamber 69.

As shown in FIGS. 5A-E, the main priming chamber 60 and the flash hole 28 may have cooperating shapes to direct the most efficient flame pattern from the primer to the propellant chamber 69. The main priming chamber is preferably conical, but can is have other shapes such as cylindrical or other preferably symmetrical shapes. The flash hole may include a conical, reverse conical or cylindrical upper section or entire throat area.

The design provides several advantages over the previous designs:

Firstly, the primer shelf 54 provides a constant and controllable seating depth. In previous designs the conical anvil needed to be precisely located during installation to produce a reliable primer. The present flat surface of the primer shelf is easier to install at a controlled depth to provide a reliable and fixed surface for a firing pin strike since it is affixed to the cylindrical priming body in an unmoveable location.

Secondly, the primer is easier and more cost effective to manufacture. Because the cylindrical primer body 52 contains all of the elements of the primer such as the anvil, etc., it is easier to manufacture. The primer can be directly added to the cylindrical primer body and the seals can be directly affixed to the cylindrical body. This increases the cost effectiveness of the manufacture.

Thirdly, the primer provides for a longer cartridge life and firing pin life by protecting the primer pocket from damage/stretching and also eliminating any stress to the bottom cartridge brass area. The cylindrical primer works as a solid block that absorbs any resulted stress within the cartridge and prevents it from effecting the original brass. It also provides a level surface for the firing pin impact, giving the firing pin a smooth surface to strike, unlike other type of primers where they have a pointed hard surface anvil that will present a hard impact resistance to the firing pin tip.

Another issue involving hot primers and back pressure that can occur in the typical market primers (i.e., Boxer and Berdan cartridges) is due to lack of available precision control in the amount of priming mixture that is inserted and adhered to in the brass cup. The difficulty of an imprecise amount will lead to either adding too much energy and gases to the primer pocket causing uncontrolled/unintended expansion which may cause damage to the brass material and to the firing pin. It may also add sudden propulsive power to the cartridge interior that may result in the bullet leaving the cartridge prematurely, that is, before fully efficient burning of the propellant smokeless powder is achieved. In another case, the back pressure where the gases inside the cartridge will want to travel and reflect in all directions except for any weak areas or holes presented to the gases. That is, the bullet exits and the small flash holes that lead into the outer cup where the firing pin stroked, in those typical primers the primer itself is almost a hollow, weak space that will accept back gases from the main cartridge burning chamber leading to a stretching/expansion and maybe dangerous and may damage the bottom of the cartridge or the firing pin, resulting in a potential injury to the shooter.

The present cylindrical drum primer cone design (or other shape) provides for an exact, precisely controlled amount of mixture that is easily determined by the maker and easily installed without the risk of miscalculation, thereby eliminating any risk of "hot" primer cases. Additionally, the present cone shape would work as a barrier to any back pressure gases that enter from the cartridge burning chamber. The cone will provide walls that narrow and lead to the narrowed tunnel/channel decreasing the strength of these back pressure gases and preventing any damage. Additionally, the cylindrical metal mass will work as a solid block that can protect and support the primer pocket from damage or stretching.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

It is therefore to be understood that the present invention is not limited to the sole embodiment described above, but encompasses any and all embodiments within the scope of the following claims.

I claim:

1. A primer for igniting propellant, comprising:

a cup made of metal having an upper closed end and a lower open end receiving a cylindrical priming body;

said priming body defining an upper shelf containing a first priming mixture;

a first seal between said priming body and said cup for hermetically sealing the first priming mixture on the upper shelf, wherein said cup is sized to fit within the rim of a cartridge ammunition case.

2. A primer according to claim 1, further comprising:

a second seal on the lower end of said priming body for cooperating with said first seal to hermetically seal said cylindrical body from the environment.

3. A primer according to claim 1, wherein said upper shelf is a cylindrical chamber defined in an upper portion of said cylindrical priming body, a circular shelf of said cylindrical chamber forming an anvil surface for compressing the first priming mixture between said cup and said anvil surface when said cup is compressed.

4. A primer according to claim 3, further comprising:

a lower chamber defined in a lower portion of said cylindrical body for containing priming mixture.

5. A primer according to claim 4, further comprising:

a throat section for communicatively connecting said cylindrical chamber and said lower chamber.

6. A primer according to claim 4, wherein the first priming mixture in said primer does not having a gluing or adhering substance.

7. A primer according to claim 1, further comprising:

having a lower chamber having a second priming mixture;

said upper shelf is a cylindrical chamber;

a throat connecting the second priming mixture in the lower chamber with the first priming mixture in the upper shelf.

8. A primer according to claim 1, wherein said lower chamber is conical.

9. A primer for igniting propellant, comprising:

a cup made of metal having an upper closed end and a lower open end receiving a cylindrical priming body;

said priming body defining an upper shelf containing a first priming mixture;

wherein said first priming mixture does not have a gluing or adhering agent, wherein said cup is sized to fit within the rim of a cartridge ammunition case.

10. A primer according to claim 9, further comprising:

a first seal between said priming body and said cup;

a second seal on the lower end of said priming body for cooperating with said first seal to hermetically seal said cylindrical body from the environment.

11. A primer according to claim 9, further comprising:

having a lower chamber having a second priming mixture;

said upper shelf is a cylindrical chamber;

a throat connecting the second priming mixture in the lower chamber with the first priming mixture in the upper shelf.

12. A primer according to claim 11, wherein said lower chamber is conical.

13. A primer according to claim 9, further comprising:

having a lower chamber having a second priming mixture;

said upper shelf is a cylindrical chamber;

a plurality of throat sections defined in the primer body connecting the second priming mixture in the lower chamber with the first priming mixture in the upper shelf.

14. A cartridge having a case, a primer, propellant and a projectile, said primer, comprising:

a cup made of metal having a upper closed end and a lower open end for is receiving a cylindrical priming body;

said priming body defining an upper shelf for containing a first, non-glue containing priming mixture;

wherein said first priming mixture does not have a gluing or adhering agent.

15. A primer according to claim 1, further comprising:

a second seal on the lower end of said priming body for cooperating with said first seal to hermetically seal said cylindrical body from the environment.

16. A primer according to claim 1, wherein said upper shelf is a cylindrical chamber having cylindrical walls and a cylindrical shelf defined in an upper portion of said cylindrical priming body, said circular shelf of said cylindrical chamber forming an anvil surface for compressing the first priming mixture between said cup and said anvil surface when said cup is compressed.

17. A primer according to claim 3, further comprising:

a lower conical chamber defined in a lower portion of said cylindrical body for containing priming mixture.

18. A primer according to claim 4, further comprising:

a throat section for communicatively connecting said cylindrical chamber and said lower chamber.

* * * * *